US010858881B2

(12) United States Patent
Mitchell et al.

(10) Patent No.: US 10,858,881 B2
(45) Date of Patent: Dec. 8, 2020

(54) THRESHOLD AND THRESHOLD CAP

(71) Applicant: Endura Products, LLC, Colfax, NC (US)

(72) Inventors: Michael K. Mitchell, Winston-Salem, NC (US); Tomasz Jaskiewicz, Oak Ridge, NC (US); Adam Kendall, Burlington, NC (US)

(73) Assignee: Endura Products, LLC, Colfax, NC (US)

( * ) Notice: Subject to any disclaimer, the term of this patent is extended or adjusted under 35 U.S.C. 154(b) by 62 days.

(21) Appl. No.: 15/962,410

(22) Filed: Apr. 25, 2018

(65) Prior Publication Data

US 2019/0330916 A1 Oct. 31, 2019

(51) Int. Cl.
*E06B 7/18* (2006.01)
*E06B 7/23* (2006.01)

(52) U.S. Cl.
CPC ..... *E06B 7/18* (2013.01); *E06B 7/2312* (2013.01); *E06B 7/2316* (2013.01)

(58) Field of Classification Search
CPC ..... E06B 7/18; E06B 7/2312; E06B 7/2316
See application file for complete search history.

(56) References Cited

U.S. PATENT DOCUMENTS 56,046 A 7/1866 Hawkins
126,014 A * 4/1872 Brown et al.
220,460 A 10/1879 York
313,742 A 3/1885 Kintner
394,864 A 12/1888 Lathrop
435,658 A * 9/1890 Brennaman
500,885 A 7/1893 Green et al.
(Continued)

FOREIGN PATENT DOCUMENTS

CA 139250 1/2012
CA 2771705 8/2014
(Continued)

OTHER PUBLICATIONS

AFCO Industries, Inc., Millwork Products Catalogue, pp. cover page, 6 (vinyl cap) and 9 (riser), believed available as of 2012, 52 pgs.

(Continued)

*Primary Examiner* — Gregory J Strimbu
(74) *Attorney, Agent, or Firm* — Womble Bond Dickinson (US) LLP

(57) ABSTRACT

A threshold has a substrate, a sill deck, an upstanding nosing, and an upstanding dam. An upwardly open sill channel is defined between the upstanding nosing and the upstanding dam. A threshold cap extends along and at least partially overlies the upwardly open sill channel. At least one holder is formed separate from the threshold cap and is located in the upwardly open sill channel between the upstanding dam and the upstanding nosing, the at least one holder at least partially supporting the threshold cap. The holder is removably disposed within the sill channel. The threshold cap is pivotably attached to the holder. The threshold cap is capable of rotating between a raised position and a lowered position. In at least the raised position, a highest point of the threshold cap is closer to the upstanding dam than the upstanding nosing.

3 Claims, 6 Drawing Sheets

(56) References Cited

U.S. PATENT DOCUMENTS 582,451 A 5/1897 Brannon
600,301 A 3/1898 Barger
618,013 A 1/1899 Roeder
628,278 A 7/1899 Mitsch
704,395 A 7/1902 Sowden
1,210,535 A 1/1917 Riley
1,468,958 A 9/1923 Champion
1,595,827 A 8/1926 Frisque
1,795,853 A 3/1931 Glass
1,883,609 A 10/1932 Dennis
1,993,506 A 3/1935 Fauner
2,108,137 A 2/1938 Oftedal et al.
2,129,361 A 9/1938 Oftedal et al.
2,131,100 A * 9/1938 Fauner ..... E06B 7/18 49/319
2,202,482 A 5/1940 Dahl
2,579,875 A 12/1951 Stanko
2,630,891 A 3/1953 Zitomer
2,663,056 A * 12/1953 Hardgrave ..... E06B 7/205 49/305
2,696,029 A 12/1954 Neff
2,728,118 A 12/1955 Gossen
2,818,614 A 1/1958 Lapka Jr.
2,949,651 A 8/1960 Hill
3,083,420 A 4/1963 Tinflow
3,114,180 A 12/1963 Riedl
3,126,051 A * 3/1964 Sussin ..... E06B 7/18 160/40
3,250,040 A 5/1966 Squires
3,273,287 A 9/1966 Pease, Jr.
3,374,579 A 3/1968 Neff
3,378,958 A 4/1968 Parks
3,402,512 A 9/1968 Peterson
3,432,966 A 3/1969 Bordner
3,448,543 A 6/1969 Mutler
3,475,866 A 11/1969 Johansen
3,521,404 A 7/1970 Hager
3,690,037 A 9/1972 Kempel
3,762,100 A 10/1973 Kempel
3,854,246 A 12/1974 McAllister
3,900,967 A 8/1975 Bursk et al.
3,962,828 A 6/1976 McAllister
3,967,412 A 7/1976 Governale
4,034,511 A 7/1977 Bursk
4,055,917 A 11/1977 Caller
4,073,093 A 2/1978 Ookawa
4,074,464 A 2/1978 McCay
4,079,550 A 3/1978 Bursk et al.
4,104,830 A 8/1978 Eagle
4,114,319 A 9/1978 Governale
4,146,995 A 4/1979 Britt
4,156,325 A 5/1979 McMullen et al.
4,185,417 A 1/1980 McKann
4,213,275 A 7/1980 Oehmig
4,224,766 A 9/1980 Proctor
4,287,684 A 9/1981 McKann
4,310,991 A 1/1982 Seely
4,352,258 A 10/1982 Burek et al.
4,387,535 A 6/1983 Corbo
D270,185 S 8/1983 Wooten
4,411,104 A 10/1983 St. Aubin
4,447,987 A 5/1984 Lesosky
4,447,989 A 5/1984 Mallancl et al.
4,513,536 A 4/1985 Giguere
D279,409 S 6/1985 Allen
4,525,953 A 7/1985 Stutzman
4,538,380 A 9/1985 Colliander
4,625,457 A 12/1986 Avery
4,628,639 A 12/1986 Lownsdale
4,686,793 A 8/1987 Mills
4,716,683 A 1/1988 Minter
4,831,779 A 5/1989 Kehrli et al.
5,010,690 A 4/1991 Geoffrey
5,012,614 A 5/1991 Shea
5,018,307 A 5/1991 Burrous et al.
5,056,263 A 10/1991 Bies
5,067,279 A 11/1991 Hagemeyer
5,136,814 A 8/1992 Headrick
5,150,544 A 9/1992 Burnett
5,174,065 A 12/1992 Schlicht
5,179,804 A 1/1993 Young
5,214,880 A 6/1993 Woodruff
5,230,181 A 7/1993 Geoffrey
5,283,977 A 2/1994 Smith
D354,572 S 1/1995 Headrick
5,426,894 A 6/1995 Headrick
5,475,946 A 12/1995 Howe
5,517,788 A 5/1996 McGough et al.
5,524,391 A 6/1996 Joffe et al.
5,588,266 A 12/1996 Headrick
5,592,782 A 1/1997 Scott
5,611,173 A 3/1997 Headrick et al.
5,638,641 A 6/1997 Joffe
5,675,935 A 10/1997 Lin
5,706,607 A 1/1998 Frey
5,857,291 A 1/1999 Headrick
5,887,392 A 3/1999 Marin
5,943,824 A 8/1999 Procton et al.
5,943,825 A 8/1999 Procton et al.
6,006,375 A 12/1999 Carr
6,052,949 A 4/2000 Procton et al.
6,061,967 A 5/2000 Judda
6,125,584 A 10/2000 Sanders
6,138,413 A 10/2000 Fehr
6,216,395 B1 4/2001 Kelly
6,289,635 B1 9/2001 Procton et al.
6,345,477 B1 2/2002 Kepler
6,367,201 B1 4/2002 Massey
6,371,188 B1 4/2002 Baczuk et al.
6,374,545 B1 4/2002 Baczuk
6,412,227 B1 7/2002 De Zen
6,484,446 B2 11/2002 Young
D488,243 S 4/2004 Babka et al.
6,763,639 B2 7/2004 Bennett et al.
6,789,358 B2 9/2004 Procton et al.
6,829,864 B2 12/2004 Mitchell et al.
7,114,293 B2 10/2006 Purlee
7,140,154 B2 11/2006 Governale
D549,850 S 8/2007 Perlman
7,263,808 B2 9/2007 Massey et al.
7,266,929 B1 9/2007 Allred et al.
7,350,336 B2 4/2008 Bennett
7,389,611 B2 6/2008 Palenske
7,472,516 B2 1/2009 Pepper et al.
7,600,346 B2 10/2009 Meeks
7,644,539 B2 1/2010 Baxter
7,669,369 B2 3/2010 Henry et al.
7,694,471 B2 4/2010 Meeks
7,788,863 B2 9/2010 Pepper
D627,488 S 11/2010 Abdollahzadeh et al.
7,878,559 B2 2/2011 Meeks
D638,142 S 5/2011 Van Camp et al.
D638,958 S 5/2011 Van Camp et al.
8,074,699 B2 12/2011 Jones et al.
8,371,069 B2 2/2013 O'Sullivan
8,375,659 B2 2/2013 Bogenhagen
8,413,383 B2 4/2013 Van Camp
8,522,483 B2 9/2013 Van Camp et al.
D696,794 S 12/2013 Mossman
D696,795 S 12/2013 Mossman
8,726,575 B1 5/2014 Vulpitta
8,813,427 B2 8/2014 Meeks
D713,976 S 9/2014 Van Camp
8,875,443 B2 11/2014 Siegel
D722,387 S 2/2015 Van Camp et al.
D722,388 S 2/2015 Van Camp
8,991,100 B2 3/2015 Van Camp et al.
8,991,101 B2 3/2015 Van Camp et al.
D733,927 S 7/2015 Van Camp
D748,284 S 1/2016 Boer
9,316,041 B2 4/2016 Olson
9,371,682 B2 6/2016 Van Camp et al.
9,487,992 B2 11/2016 Meeks
9,528,314 B2 * 12/2016 Mitchell ..... E06B 7/18

(56) References Cited

U.S. PATENT DOCUMENTS

| | | | | |
|---|---|---|---|---|
| 9,562,387 | B2 | 2/2017 | Meeks | |
| D797,309 | S | 9/2017 | Jaskiewicz et al. | |
| 9,874,054 | B2 | 1/2018 | Mitchell | |
| 10,066,433 | B2 | 9/2018 | Van Camp et al. | |
| 10,407,975 | B2 | 9/2019 | Van Camp et al. | |
| 2002/0129557 | A1 | 9/2002 | Young | |
| 2002/0194787 | A1 | 12/2002 | Bennett | |
| 2003/0005644 | A1 | 1/2003 | Reithmeyer et al. | |
| 2004/0139667 | A1 | 7/2004 | Massey et al. | |
| 2004/0200153 | A1 | 10/2004 | Khanlarian | |
| 2005/0198911 | A1 | 9/2005 | Baczuk | |
| 2005/0210754 | A1 | 9/2005 | Ferret | |
| 2005/0223647 | A1 | 10/2005 | Stutzman | |
| 2006/0053695 | A1 | 3/2006 | Palenske | |
| 2006/0174545 | A1 | 8/2006 | Young | |
| 2006/0283087 | A1 | 12/2006 | Baxter | |
| 2006/0283090 | A1 | 12/2006 | Moody | |
| 2007/0227076 | A1 | 10/2007 | Braun | |
| 2007/0261312 | A1 | 11/2007 | Kuppler | |
| 2008/0110100 | A1 | 5/2008 | Heppner | |
| 2008/0229669 | A1 | 9/2008 | Abdollahzadeh et al. | |
| 2009/0199486 | A1 | 8/2009 | Wemiund et al. | |
| 2010/0107503 | A1 | 5/2010 | Chapman | |
| 2010/0192459 | A1 | 8/2010 | McDaniel | |
| 2010/0242393 | A1 | 9/2010 | Kornfalt | |
| 2010/0257789 | A1 | 10/2010 | Meeks | |
| 2012/0079771 | A1 | 4/2012 | Meulemans | |
| 2012/0324817 | A1 | 12/2012 | Stanchfieid | |
| 2013/0047518 | A1 | 2/2013 | Van Camp et al. | |
| 2013/0199900 | A1 | 8/2013 | Van Camp | |
| 2013/0276376 | A1 | 10/2013 | Gilbert | |
| 2013/0305610 | A1* | 11/2013 | Meeks | E06B 1/70 49/471 |
| 2016/0145931 | A1 | 5/2016 | Meeks | |
| 2016/0265264 | A1* | 9/2016 | Van Camp | E06B 1/70 |
| 2016/0340968 | A1 | 11/2016 | Mitchell et al. | |
| 2017/0058592 | A1* | 3/2017 | Meeks | E06B 1/70 |

FOREIGN PATENT DOCUMENTS

| | | | |
|---|---|---|---|
| CA | 2842214 | | 9/2014 |
| CA | 153751 | | 9/2015 |
| CA | 153953 | | 9/2015 |
| CA | 166338 | | 9/2016 |
| CA | 166339 | | 9/2016 |
| CA | 170072 | | 5/2017 |
| CA | 2928089 | | 7/2017 |
| CA | 177370 | | 10/2018 |
| CN | 3480288 | | 10/2005 |
| DE | 2135919 | A1 | 7/1971 |
| DE | 19932332 | A1 | 2/2001 |
| DE | 19932332 | C2 | 10/2003 |
| EP | 327840 | | 8/1989 |
| FR | 945217 | A | 4/1947 |
| GB | 189809888 | A | 3/1899 |
| GB | 411361 | | 6/1934 |
| GB | 2063341 | | 6/1981 |
| JP | 1986085690 | | 6/1986 |
| JP | 06026278 | | 2/1994 |
| JP | 10037626 | | 2/1998 |
| JP | 10102937 | | 4/1998 |
| JP | 10110579 | A | 4/1998 |
| JP | 2003013672 | | 1/2003 |
| JP | 2005023628 | | 1/2005 |
| KR | 100594929 | B1 | 6/2006 |

OTHER PUBLICATIONS

American Architectural Manufacturers Association, AAMA AG-11 AAMA Glossary, believed to be available as of 2011, pp. 50 ("threshold"), 54 ("weatherstrip"), (http://www.aamanet.org/general/1/241/skylight-glossary-of-terms, accessed on Mar. 20, 2013), 58 pgs.

Combo Aluminum Products, 50th Anniversary Catalog, believed to be available 2008, cover page, pp. 1, 28 (hardwood cap), 31 (composite cap), 45 (foam weather-strip), (http://www.comboaluminum.com/Catatog/Combo_Aluminum_Catalog.pdf, accessed Mar. 20, 2013), 59 pgs.

Endura Products, Glossary, 7 pages ("Cap/Riser", "Sill", "Weatherstrip"). available as of Aug. 22, 2011 (http://www.enduraproducts.com/technical-info/glossary.aspx, accessed Mar. 20, 2013).

Official Action of U.S. Appl. No. 13/215,905, dated Feb. 15. 2013. 17 pgs.

Official Action of U.S. Appl. No. 13/215,905, dated Nov. 14, 2012, 16 pgs.

Profile Selection Guide Building Products Division, Schlegel Systems, Inc., believed to be available as of Jun. 2008, page entitled T-Slot APTUS® TPE Weatherseals, 3 pgs.

ThermaTru Doors Product Manual, Comp 13, Comp11, Jan. 2011 (online). Designs shown therein known at least as early as Aug. 24, 2010. Retrieved, on Mar. 3, 2011: <URL: www.thermatru.com/customer-support/technical-manuals/ArchComp/Comp-12-14.pdf>; <URL: http://www.thermatru.com/customer-support/technical-manuals/manuals/ArchComp/Comp11.pdf>, 6 pgs.

ThermaTru Doors Product Manual, Comp 13, Kerf Door Bottom, Jun. 2005, 2 pgs.

ThermaTru Doors, Sills Product Manual, Comp 11, Self-Adjusting Thermal Break Sill, Jun. 2005, 4 pgs.

Window & Door Manufacturers Association, The Door Glossary, AAMA/WDMA/CSA 101/I.S.2/A440-11, NAFS—North American Fenestration Standard/Specification for Windows, Doors, and Skylights, believed to be available 2011, (https://www.wdma.com/TechnicalCenter/TheDoorGlossary/tabid/84/Default.aspx, accessed on Mar. 20, 2013), 9 pgs.

Window & Door Manufacturers Association, The Window Glossary, AAMA/WDMA/CSA 101/I.S.2/A440-11, NAFS—North American Fenestration Standard/Specification for Windows, Doors, and Skylights, believed to be available 2011, (https://www.wdma.com/TechnicalCenter/TheWindowGlossary/tabid/109/Default.aspx, accessed on Mar. 18, 2013), 11 pgs.

Endure Products Sill Systems, https://www.enduraproducts.com/products/sills-sill-systems/, available Dec. 2016, 1 pg.

GPI Millworks, Outswing Sill, https://gpimillworks.com/pultruded-fiberglass-sills/, known at least as early as Apr. 24, 2018, 1 pg.

Therma-tru Doors, Composite Outswing Sill, 2016 Full-Line Catalog, known at least as early as Apr. 24, 2018. 1 pg.

Worldwide Door Components, Outswing Sill, http://www.wwph.com.cn/products.asp?class_pd=2&id=2&class_pd2=2&class_pd3=2&fi=THRESHOLDS, known at least as early as Apr. 24, 2018, 1 pg.

Canadian Office Action for Application No. 3,003,054, dated Jun. 6, 2019, 4 pgs.

Association of Millwork Distributors, Millwork Principles and Practices; believed to be available as of 2010, pp. cover page, 130 (door sill), 131 (threshold), 160 (adjustable sill), 162 (weatherstrip), 6 pgs.

Door Sill drawing, known as of Apr. 19, 2010, 1 pg.

Threshold Sill, Imperial, known as of Mar. 19, 2007.

Threshold Sill, Stanley, known as of Mar. 19, 2007.

* cited by examiner

THRESHOLD AND THRESHOLD CAP

FIELD OF DISCLOSURE

The present disclosure relates generally to thresholds for residential and commercial buildings. Many embodiments of the present disclosure relate to thresholds having threshold caps that are self-adjusting.

BACKGROUND

Entryways provide the necessary ingress and egress from residential and commercial buildings. Entryway systems used in building construction generally include a pair of vertically extending door jambs and a head jamb that frame the entryway and receive at least one hinged door panel. An elongated threshold is generally attached at its ends to the bottoms of the door jambs, and spans the bottom of the entryway. Many modern thresholds include a threshold cap positioned to underlie a closed door mounted in the entryway. In some instances, the threshold cap is manually adjustable in a vertical direction to engage and form a seal with the bottom of the door panel or a flexible sweep attached thereto. Manually adjustable threshold caps remain stationary as the door opens and closes.

Manufacturers of entryway systems and components thereof, continue to seek designs that provide a durable, weather-tight seal. The goal of these components is to function as a system to prevent the unwanted infiltration of air or water through the entryway when the door panel is closed. One known problem is that houses can settle after construction, thus compromising the weather sealing of the door panel due to movement of the mating components from their initial installed position. In the past, a homeowner could vertically adjust the threshold cap manually in order to correct this issue. Experience has shown, however, that homeowners rarely use the adjustment features of the prior art. Accordingly, a need continues to exist for a threshold that improves the ability to seal out air and water along the bottom of the door panel even as the fit between a door panel and the threshold changes.

SUMMARY

One embodiment of the present disclosure includes an assembly for forming a seal with a door panel. The assembly comprises a holder comprising at least one knuckle for at least partially forming a barrel, the barrel having a longitudinal axis, and a threshold cap configured to underlay the door panel when the door panel is in a closed position. The threshold cap comprises a first wall having a top surface and a bottom surface and a connection arm extending from the bottom surface. The connection arm terminates in a tip having a substantially circular profile. The tip is received in the barrel such that the threshold cap is capable of pivoting relative to the holder about the longitudinal axis.

Another embodiment of the present disclosure includes a threshold for installation in an entryway. The threshold comprises a substrate, a sill deck mounted to the substrate, an upstanding nosing extending along an interior portion of the substrate, and an upstanding dam extending along an inward end of the sill deck. An upwardly open sill channel is defined between the upstanding nosing and the upstanding dam. The upwardly open sill channel is positioned to at least partially underlie a door panel when the door panel is in a closed position. A threshold cap extends along and at least partially overlies the upwardly open sill channel. At least one holder formed separate from the threshold cap is located in the upwardly open sill channel between the upstanding dam and the upstanding nosing. The at least one holder at least partially supports the threshold cap. The holder is removably disposed within the sill channel. The threshold cap is pivotably attached to the holder. The threshold cap is capable of rotating between a raised position and a lowered position. In at least the raised position, a highest point of the threshold cap is closer to the upstanding dam than the upstanding nosing.

These and other aspects of the present invention will become apparent to those skilled in the art after a reading of the following description of the preferred embodiments, when considered in conjunction with the drawings. It should be understood that both the foregoing general description and the following detailed description are explanatory only and are not restrictive of the invention as claimed.

DETAILED DESCRIPTION

Exemplary embodiments of this disclosure are described below and illustrated in the accompanying figures, in which like numerals refer to like parts throughout the several views. The embodiments described provide examples and should not be interpreted as limiting the scope of the invention. Other embodiments, and modifications and improvements of the described embodiments, will occur to those skilled in the art and all such other embodiments, modifications and improvements are within the scope of the present invention. Features from one embodiment or aspect may be combined with features from any other embodiment or aspect in any appropriate combination. For example, any individual or collective features of method aspects or embodiments may be applied to apparatus, product or component aspects or embodiments and vice versa.

Figure 1:
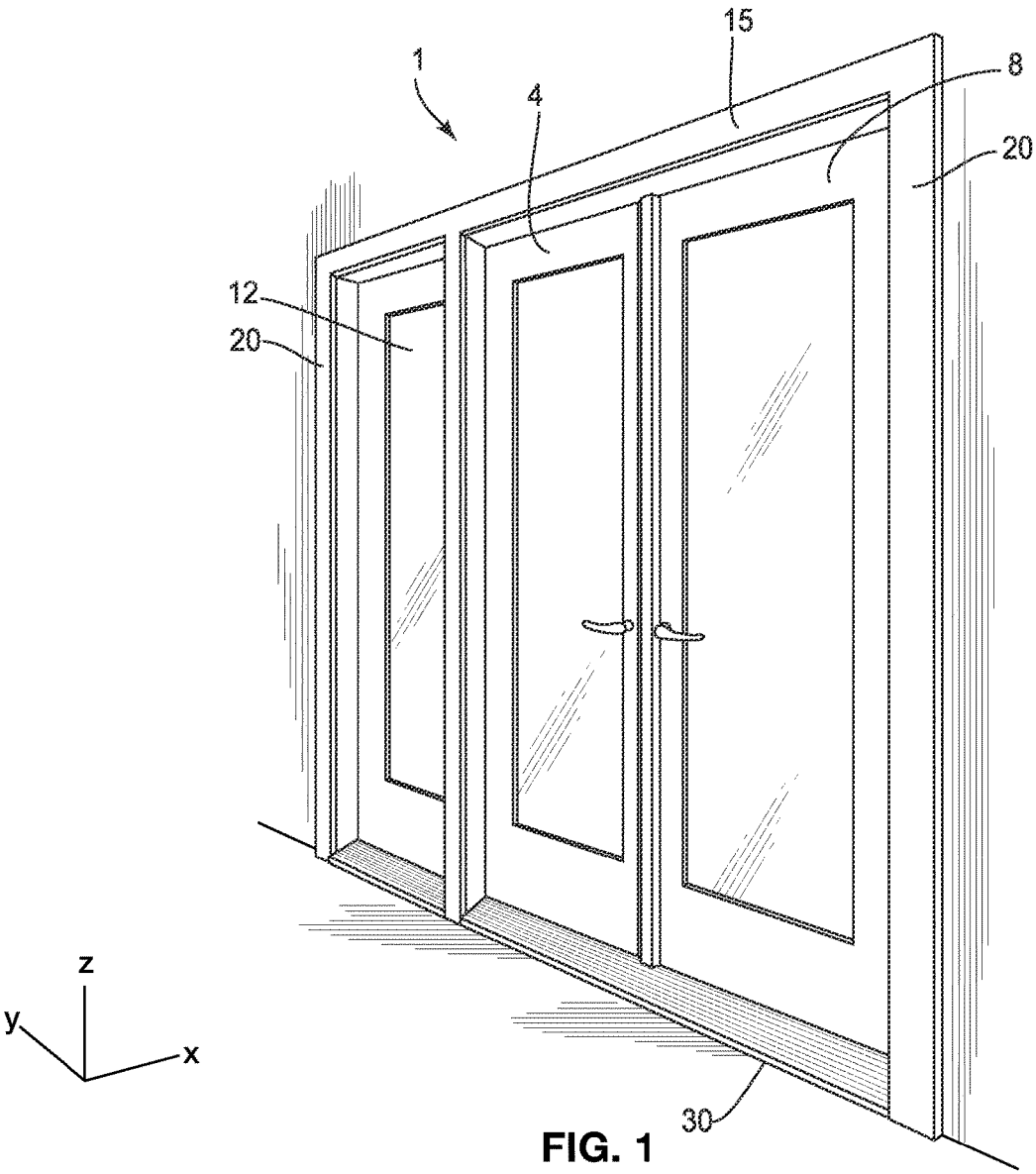
FIG. 1 is a schematic view of an entryway that may benefit from the threshold disclosed herein.

FIG. 1 illustrates an entryway 1 that may incorporate one or more components of the present disclosure. The illustrated entryway 1 includes a French door arrangement with a first door panel 4 and a second door panel 8. The entryway 1 is also shown with a sidelight 12. The top of the entryway 1 includes a header 15, and the edges of the entryway 1 can be defined by side jambs 20. A threshold 30 extends along the bottom of the entryway 1. The configuration of the entryway 1 shown in FIG. 1 is provided as an example only and is not intended to limit the scope of this disclosure. Particularly, the entryway 1 may include only a single door panel, a double door entryway, or even a larger plurality of door panels and windows.

The illustrated embodiments of the present disclosure apply primarily to in-swing type entryways where the door panel is within the interior of the building when the door panel is open. However, unless expressly noted, the type of entryway, e.g., in-swing or out-swing, should not affect the scope of this disclosure. As used herein, the terms interior, inner, inward, etc., and the terms exterior, outer, outward, etc., are used to describe relative positions of features with respect to the entryway 1, the threshold 30, and the inside and outside of a corresponding building when the threshold is in-use. Notably, FIG. 1 illustrates the exterior of the entryway 1. Also, as used herein, the width direction extends from an interior to an exterior of a building, or vice versa. The width direction is defined along the X-axis shown in FIG. 1. The length direction extends relatively between the side jambs 20 of the entryway 1 parallel with the Y-axis shown in FIG. 1. The height direction extends substantially along the vertical direction and parallel with the major axis of the side jambs 20, parallel to the Z-axis in FIG. 1. As used herein, the terms "rigid" and "resilient" are used with respect to one another. Therefore, when an element made from rigid material interacts with an element made from a resilient material, the resilient element will deform more readily than the rigid element. As used herein, rigid materials are intended to maintain their shape and resilient materials are intended to be pliable to alter their shape when faced with anticipated external forces.

Figure 2:
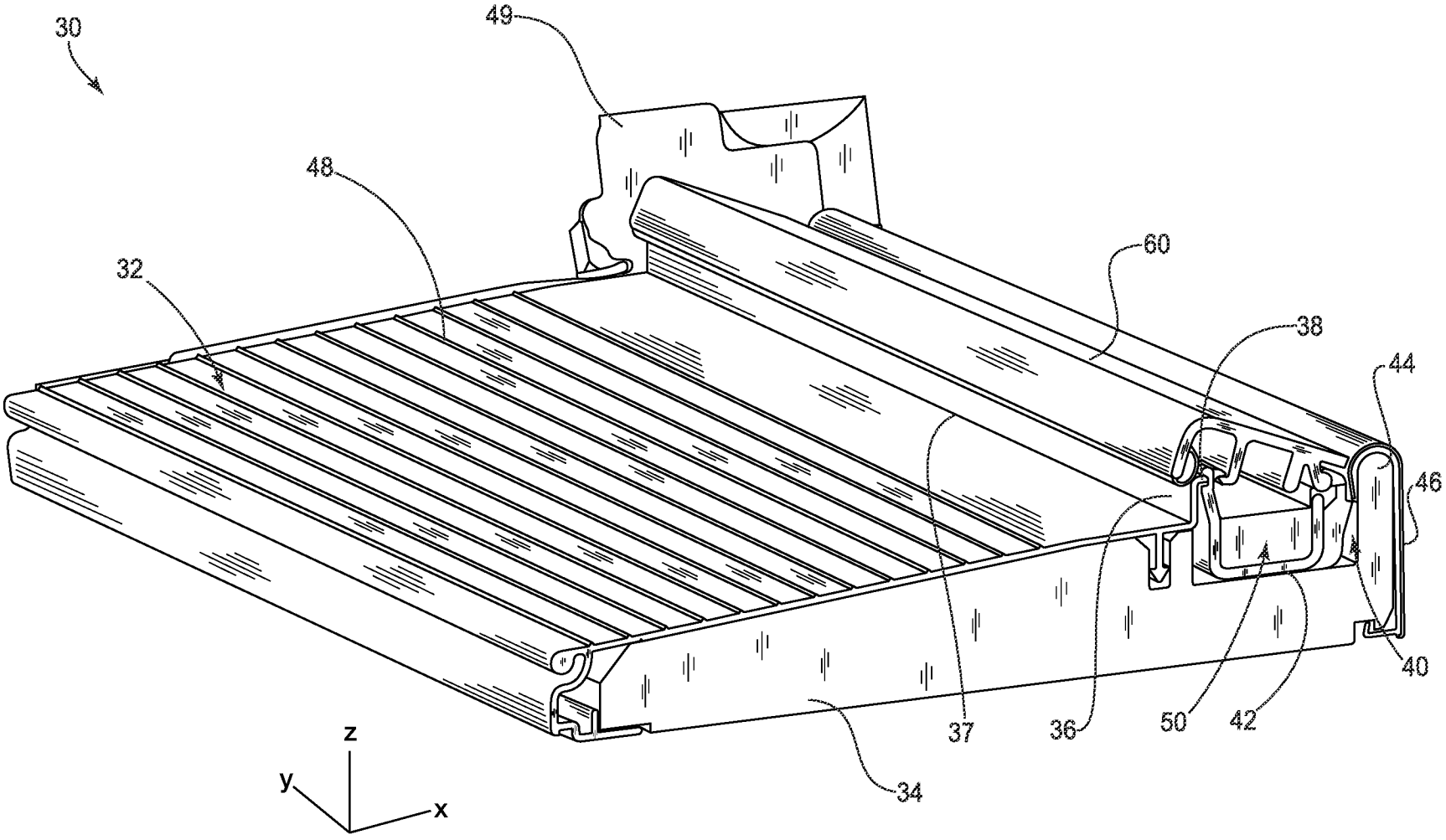
FIG. 2 is a perspective view of a threshold according to an embodiment of the present disclosure.

FIG. 2 shows a portion of an assembled threshold 30 according to an embodiment of the present disclosure from an exterior perspective view. As shown, the threshold 30 may include a sill deck 32 disposed upon a substrate 34. A dam 36 may extend upwardly from an inward end 37 of the sill deck 32. In some embodiments, the dam 36 may be formed as part of the sill deck 32. In other embodiments, the dam 36 may be formed separate from the sill deck 32. The dam 36 may include a lip 38 at the top thereof. The lip 38 may extend substantially horizontally in an inward direction. Interior of the dam 36, a sill channel 40 may be formed. The sill channel 40 can be described as upwardly open. The sill channel 40 may have an exterior wall formed at least partially by the dam 36. The sill channel 40 can have a lower surface provided by a floor 42, which may be at least partially defined by the substrate 34. An interior wall, which can be formed at least partially by a nosing 44, can provide the third wall of the sill channel 40. The nosing 44 may be formed as an integral part of the substrate 34 as shown, or the nosing 44 may be separately attached to the substrate 34. In several embodiments, a decorative nosing cover 46 may be provided over and around the nosing 44. The sill deck 32 may provide a tread surface 48 along a portion outward of the dam 36. The threshold 30 may be sealed to the jambs 20 (FIG. 1) using gaskets 49. Example gaskets that may be suitable for use with the threshold of the present disclosure are described in U.S. Pat. No. 9,624,716 to Mitchell.

The threshold 30 of FIG. 2 may also include one or more holders 50 positioned within the sill channel 40 to support and retain a threshold cap 60. In some embodiments, the holders 50 are substantially entirely within the sill channel 40. In some embodiments, not shown, the holder 50 may be integral with the substrate 34 or integral with the sill deck 32. In the illustrated embodiment, the holder 50 is removably disposed within the sill channel 40. Configuring the holder 50 to be removable from the sill channel 40 may be advantageous for manufacturing and assembly purposes, such as creating interchangeability of component parts to provide multiple products with fewer unique components. In an embodiment, a plurality of holders 50 are used to support the threshold cap 60, the holders 50 being spaced apart along a length of the sill channel 40.

Figure 3:
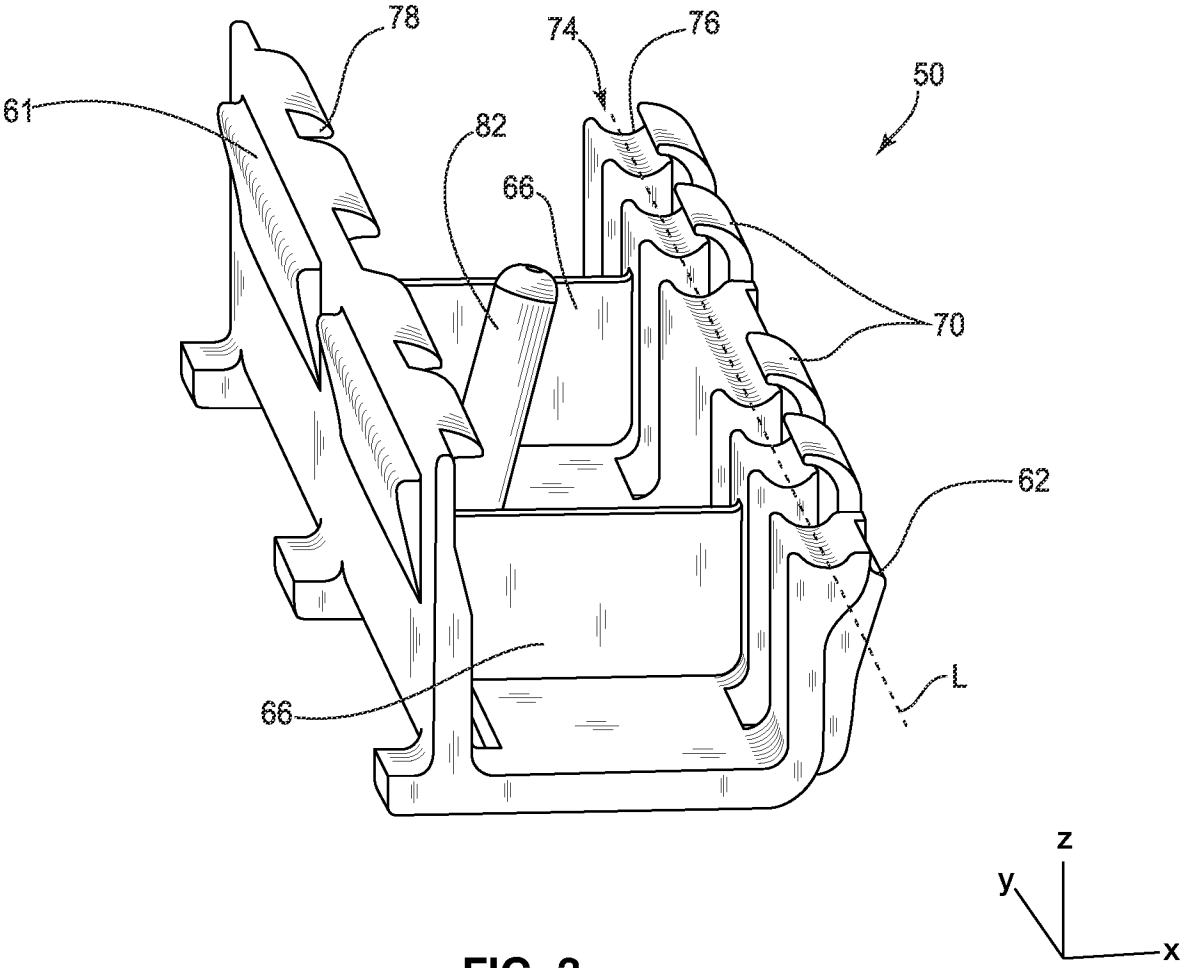
FIG. 3 is a perspective view of a cap holder according to an embodiment of the present disclosure.
Figure 5:
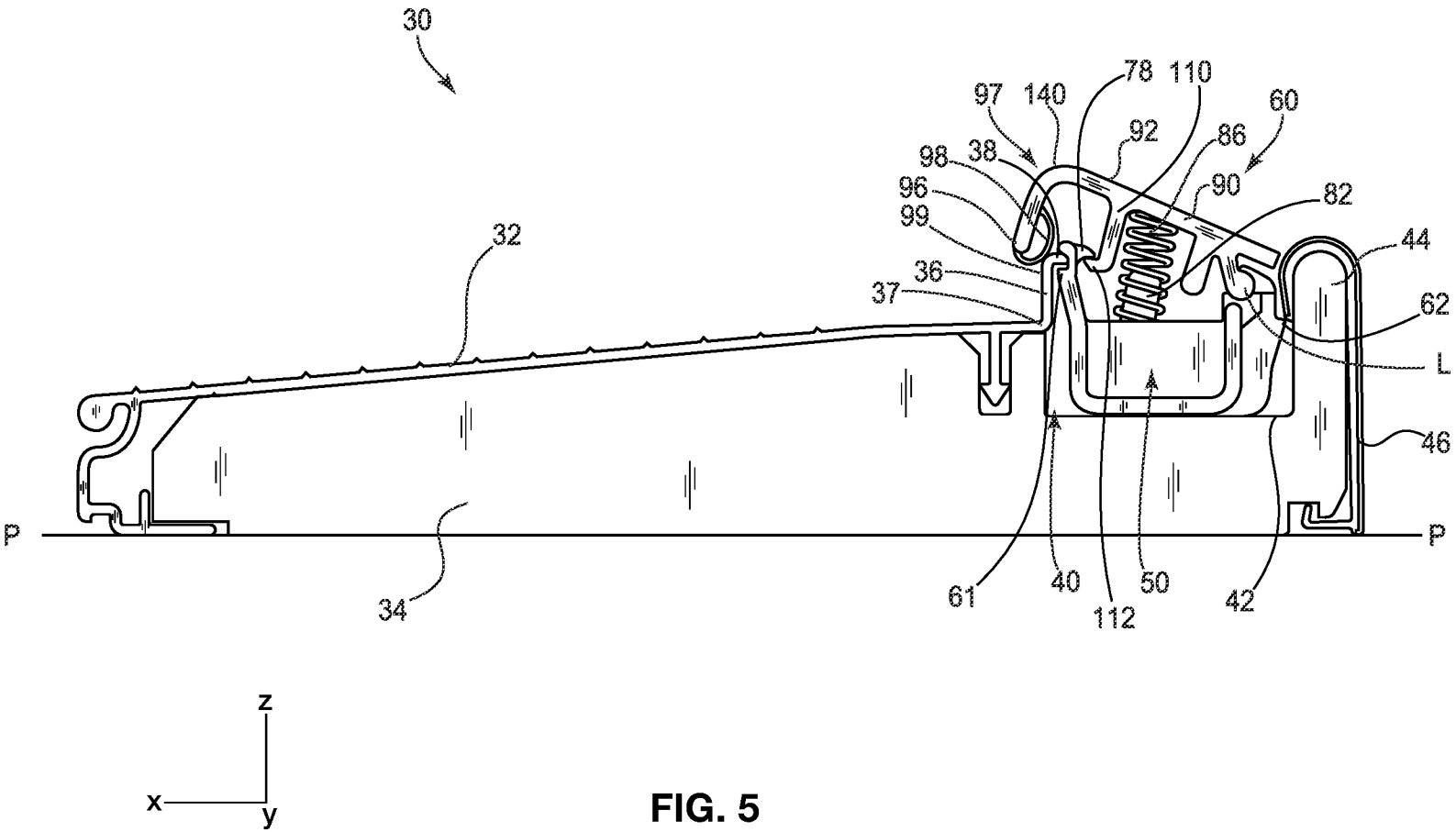
FIG. 5 is an end view of the threshold in a raised, door open position.

FIG. 3 shows a detailed perspective view of a holder 50 according to one embodiment of the present disclosure. The holder 50 may be designed to have a width (along the x-axis) configured to substantially fill the width of the sill channel 40 (FIG. 2). In one embodiment, during assembly of the threshold 30, the holder 50 may be able to slide along the length of the sill channel 40. The holder 50 may be configured to be retained in the sill channel 40 along a vertical direction (z-axis) through an interference fit. For example, the holder 50 of the illustrated embodiment includes one or more outer retention projections 61 and one or more inner retention projections 62 configured to engage with the lip 38 of the dam 36 and the nosing cover 46 respectively, to retain the holder within the sill channel 40 as shown in FIG. 5.

The holder 50 may be formed from plastic, such as polypropylene. The holder 50 may be formed from processes such as injection molding or additive manufacturing. Depending upon the materials used and the process selected for manufacturing, the holder 50 may include stiffening elements, such as braces 66.

One function of the holders 50 is to support the threshold cap 60 (FIG. 2) with respect to the sill channel 40. Consistent with this function, the holders 50 may be configured to retain the threshold cap 60 and control a range of motion of the threshold cap. To provide retention, the holder 50 may be provided with a plurality of knuckles 70, which are configured to at least partially define a barrel 74. In but one example, seats 76 are arranged in a staggered manner with the knuckles 70 to further define the barrel 74. The barrel 74 has a longitudinal axis L configured to extend along the length (y-axis) of the threshold 30 and define the axis about which the threshold cap 60 may be able to pivot.

To control the range of motion of the threshold cap 60, the holder 50 may be formed with a catch 78 configured to provide an abutment surface for engaging a portion of the threshold cap 60 and limiting upward movement of the threshold cap as discussed further below.

Figure 6:
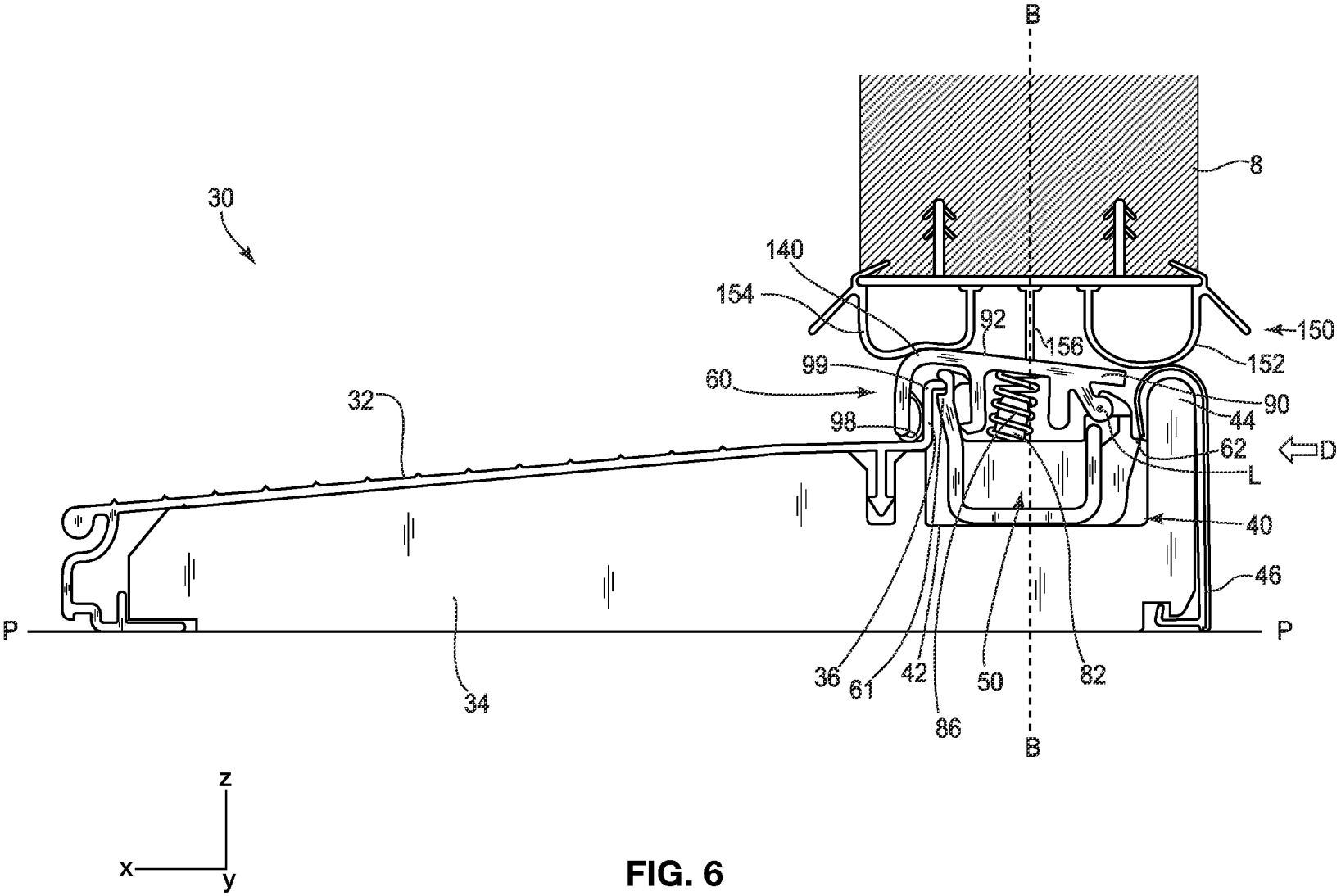
FIG. 6 is an end view of the threshold in a lowered, door closed position.

The holder 50 may also include a post 82. The post 82 may be configured to extend along a vertical direction (the z-axis) or may be provided at a pre-determined angle relative to vertical. For example, the post 82 may be configured to be substantially normal to a top wall of the threshold cap 60 in at least one position of the threshold cap. As shown in FIGS. 5 and 6, the post 82 may be configured to support a coil spring 86 between the holder 50 and the threshold cap 60. The spring 86 may be included to provide a force intending to bias the threshold cap 60 toward a raised position thereof (FIG. 5), both when a corresponding door panel is open and when the corresponding door panel is closed. The present disclosure is not limited to biasing the threshold cap 60 with a coil spring 86, but may alternatively include other resilient members formed from resilient materials capable of providing a spring force, such as a leaf spring, or elastic memory materials such as rubber, foam, or Hytrel® that are capable of acting to provide a force which acts to move the threshold cap toward the raised position when the elastic material is deformed. The spring 86 or other resilient member used for biasing the threshold cap 60 may be relatively separate from the threshold cap 60 and the base 50 as shown in the presently illustrated embodiment. Alternatively, the resilient member may be integrated with the holder 50 or integrated with the threshold cap 60.

Figure 4:
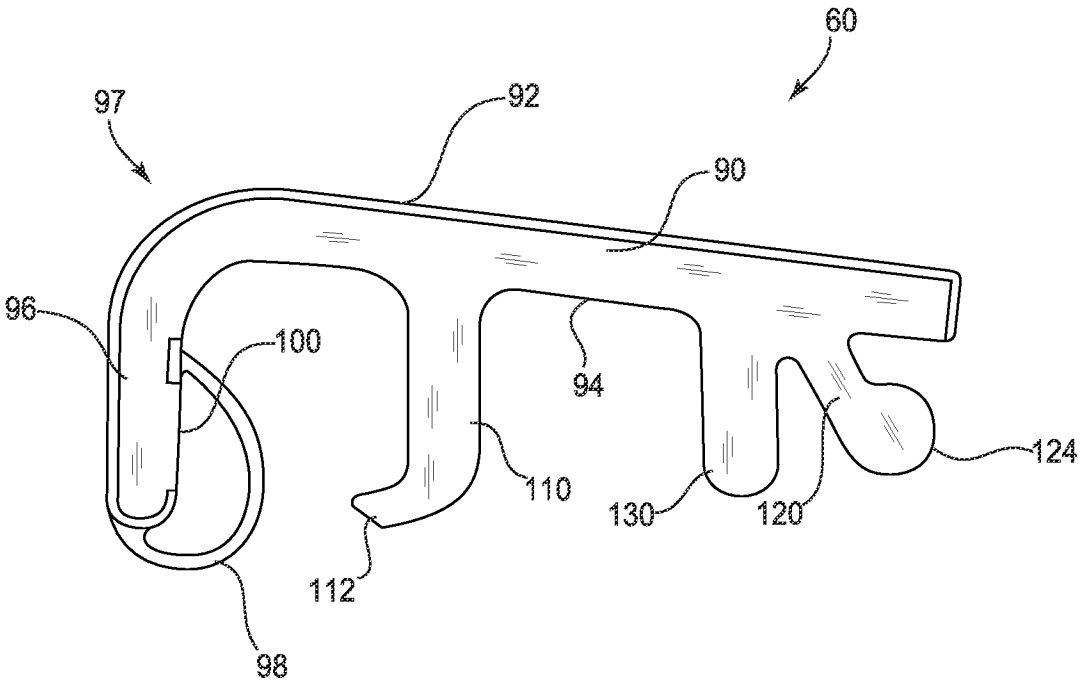
FIG. 4 is a profile view of a threshold cap according to an embodiment of the present disclosure.

FIG. 4 provides a detailed profile view of the threshold cap 60 according to one embodiment of the present disclosure. The threshold cap 60 includes a first wall 90 having a top surface 92 and a bottom surface 94. The top surface 92 of the first wall 90 is configured to provide a sealing surface when a door panel is in the closed position. A second wall 96 may extend from an exterior end 97 of the first wall. The second wall 96 may extend substantially perpendicularly from the bottom surface 94 of the first wall 90 at the exterior end 97 thereof. The second wall 96 may be configured to be positioned along an exterior side 99 of the dam 36 as shown in FIGS. 5 and 6. A seal 98 may be attached at least partially to an interior surface 100 of the second wall 96. The seal 98 is configured to limit intrusion of water between an interior surface 100 of the second wall 96 and the exterior side 99 of the dam 36. The seal 98 may be a resilient bulb. The seal 98 may be co-extruded with the remainder of the threshold cap 60. Alternatively, the seal 98 may be joined to the second wall 96 by other attachments. In other embodiments, the seal 98 may be attached to the dam 36 instead of being movable with the second wall 96.

As shown in FIG. 4, the threshold cap 60 may further comprise a stop arm 110 extending from the bottom surface 94 of the first wall 90. The distal end of the stop arm 110 may include a tab 112 providing an abutment surface to facilitate limiting the range of motion of the threshold cap 60 as discussed in further detail below.

As shown in FIG. 4, the threshold cap 60 further comprises a connection arm 120. The distal end of the connection arm 120 may be formed with a tip 124 having substantially circular profile. The tip 124 is configured for insertion into the barrel 74 created by the holder 50 (FIG. 3), wherein the tip may be able to function as a pin of a hinge as the threshold cap 60 is able to pivot relative to the holder 50.

FIG. 4 also shows an optional rib 130 extending from the bottom surface 94 of the first wall 90. The optional rib 130 may add to the rigidity of the first wall 90. The rib 130 may also assist with the desired positioning of the spring 86 as shown in FIG. 5.

The first wall 90, second wall 96, stop arm 110, connection arm 120, and optional rib 130 may all be integrally formed with one another, for example by a polymer or metal extrusion process that creates the threshold cap 60 with a substantially constant profile along the length thereof. When cooled or otherwise cured, the first wall 90, second wall 96, stop arm 110, connection arm 120, and optional rib 130 may be formed from a material, such as PVC or aluminum, to produce a substantially rigid body. Thus, the threshold cap 60 is configured to rotate about the longitudinal axis L (FIG. 3) without significant bending or flexing of the threshold cap 60 itself.

FIG. 5 shows the threshold 30 with the threshold cap 60 in an upwardmost position. As shown, the threshold cap 60 may be constantly biased toward the upwardmost position by the spring 86 or other resilient member in the illustrated embodiment. The threshold cap 60 may assume the upwardmost position when a corresponding door panel (e.g., door 8 in FIG. 1) is in the opening position. In the upwardmost position, the catch 78 may engage the tab 112 of the stop arm 110 to limit the upward rotation of the threshold cap 60.

The upwardmost position may be configured to locate the highest point 140 of the top surface 92 of the first wall 90 about ¼ inches above the top of the dam 36.

As described above, the second wall 96 is configured to be positioned along an exterior side 99 of the dam 36. The pivot axis L of the threshold cap 60 is positioned substantially adjacent to the nosing 44. As a result, the exterior end 97 of the first wall 90 may define the portion of the threshold cap 60 farthest from the pivot axis L, and therefore the portion which may adjust by the greatest magnitude along a vertical direction. The exterior end 97 may also define a point that achieves the highest position relative to a reference plane P, which may be defined by the bottom of the substrate 34.

FIG. 6 shows a door panel 8 in a closed position. A bottom surface of the door panel 8 may carry a door sweep 150 for forming a seal with the first wall 90 of the threshold cap 60. One suitable door sweep 150 may include an interior bulb 152, an exterior bulb 154, and an intermediate fin 156, each formed of a resilient material and configured to form a seal with the top surface 92 of the rigid first wall 90 of the threshold cap 60. While pliable, the resilient portions of the door sweep 150 are configured to provide sufficient force on the first wall 90 of the threshold cap 60 to oppose the biasing force provided by the spring 86 and cause the threshold cap to pivotably deflect downward away from the upwardmost position shown in FIG. 5 to a lowered position as shown in FIG. 6.

Again, the threshold 30 of the illustrated example may be preferably used with an in-swing door. Therefore, to close the door panel 8 to the position shown in FIG. 6, the door panel travels in the direction of arrow D in FIG. 6. The threshold cap 60, with the exterior end 97 of the first wall 90 capable of providing the highest point 140 of the threshold cap above the reference plane P, creates the primary sealing location. The primary sealing location may have the greatest pressing force between the first wall 90 and one of the resilient portions of the door sweep 150. The primary sealing location is at a position closer to the dam 36 than the nosing 44. The threshold cap 60 is arranged such that the primary sealing location is directly under the door panel 8. Due to the pivoting direction of the threshold cap 60, the primary sealing location is positioned exterior of a bisector B normal to the bottom of the door panel 8. To avoid water penetration across the threshold 30, forming the primary sealing location as far toward the exterior of the building as possible is desired, particularly if that seal is a dynamic seal formed by at least one element subject to an upward biasing force.

In addition, when the threshold cap 60 is raised to its upwardmost position as shown in FIG. 5, the first wall 90 ramps upward toward the exterior of the threshold 30. The act of closing the door panel 8 from the interior along direction D (FIG. 6) provides an initial depression force at a relatively lower, interior portion of the first wall 90, therefore reducing resistance and friction between the door sweep 150 and the threshold cap 60 compared to self-articulating threshold caps having their highest portions positioned toward an interior of the building relative to the bisector B of the door panel.

Although the above disclosure has been presented in the context of exemplary embodiments, it is to be understood that modifications and variations may be utilized without departing from the spirit and scope of the invention, as those skilled in the art will readily understand. Such modifications and variations are considered to be within the purview and scope of the appended claims and their equivalents.

We claim:

1. A threshold for installation in an entryway, the threshold having a first side and a second side opposite the first side, the threshold comprising:

a substrate;

a sill deck mounted to the substrate;

an upstanding nosing extending along the second side of the threshold;

and upstanding dam extending from the sill deck;

an upwardly open sill channel is positioned between and partially defined by the upstanding nosing and the upstanding dam, the upwardly open sill channel being positioned to at least partially underlie a door panel when the door panel is in a closed position;

a threshold cap extending along and at least partially overlying the upwardly open sill channel, the threshold cap comprising:

a first wall having a top surface and a bottom surface, and a connection arm extending from the bottom surface and terminating in a tip having a substantially circular profile; and at least one holder formed separate from the threshold cap and being located in the upwardly open sill channel between the upstanding dam and the upstanding nosing, the at least one holder at least partially supporting the threshold cap;

wherein the holder is removably disposed within the sill channel, wherein the holder comprises at least one knuckle at least partially forming a barrel having a longitudinal axis, wherein the threshold cap is pivotably attached to the holder, wherein the threshold cap is capable of rotating between a raised position and a lowered position, wherein, in at least the raised position, a highest point of the threshold cap relative to the substrate is closer to the upstanding dam than the upstanding nosing, and wherein the tip is received in the barrel such that the threshold cap is capable of pivoting relative to the holder about the longitudinal axis.

2. The threshold of claim 1, wherein the threshold cap further comprises a second wall extending from the first wall, the second wall extending substantially perpendicularly from the first wall, the second wall configured to be positioned adjacent the upstanding dam.

3. The threshold of claim 2, wherein the second wall further comprises at least one resilient seal configured to seal with the dam.

* * * * *